US009719416B2

(12) United States Patent
Imafuku et al.

(10) Patent No.: US 9,719,416 B2
(45) **Date of Patent: *Aug. 1, 2017**

(54) STRATIFIED SCAVENGING TWO-STROKE ENGINE

(71) Applicant: MAKITA CORPORATION, Aichi (JP)

(72) Inventors: Kenji Imafuku, Tokyo (JP); Junichi Masuda, Tokyo (JP); Yoshifumi Watanabe, Tokyo (JP); Hideaki Hirano, Tokyo (JP)

(73) Assignee: MAKITA CORPORATION, Aichi (JP)

( * ) Notice: Subject to any disclaimer, the term of this patent is extended or adjusted under 35 U.S.C. 154(b) by 231 days.

This patent is subject to a terminal disclaimer.

(21) Appl. No.: 14/262,013

(22) Filed: Apr. 25, 2014

(65) Prior Publication Data

US 2014/0318517 A1 Oct. 30, 2014

(30) Foreign Application Priority Data

Apr. 30, 2013 (JP) ..... 2013-095198

(51) Int. Cl.
*F02B 75/02* (2006.01)
*F02B 25/22* (2006.01)
(Continued)

(52) U.S. Cl.
CPC ..... *F02B 75/02* (2013.01); *F02B 25/14* (2013.01); *F02B 25/22* (2013.01); *F02B 63/02* (2013.01); *F02B 2075/025* (2013.01)

(58) Field of Classification Search
CPC ..... F02B 75/02; F02B 25/14; F02B 25/22
See application file for complete search history.

(56) References Cited

U.S. PATENT DOCUMENTS 4,066,050 A * 1/1978 Ford-Dunn ..... F01L 3/205 123/73 A
6,408,805 B2 * 6/2002 Uenoyama ..... F02B 25/14 123/65 P (Continued)

FOREIGN PATENT DOCUMENTS

AT 394 755 6/1992
DE 10 2004 053 698 5/2006

(Continued)

OTHER PUBLICATIONS

German Official Action with English translation for Application No. DE 10 2014 006 062.4, having a mailing date of Jul. 10, 2015.

(Continued)

*Primary Examiner* — Kevin Lathers
(74) *Attorney, Agent, or Firm* — Greenblum & Bernstein, P.L.C.

(57) ABSTRACT

A stratified scavenging two-stroke engine includes: an intake passage that connects an intake opening through an outer surface of a cylinder member with an intake port opening to the inside of a cylinder, and supplies gaseous mixture of fuel and air; an exhaust passage that connects an exhaust outlet opening through the outer surface of the cylinder member with an exhaust port opening to the inside of the cylinder, and discharges combustion gas; a scavenging passage; and an air passage that connects an air inlet opening through the outer surface of the cylinder member with the scavenging passage and supplies pre-scavenging air into the scavenging passage. The intake and the air inlet are arranged at positions opposite from the exhaust port across the axis of the cylinder, and arranged side by side in a substantially circumferential direction of the cylinder or a direction substantially perpendicular to the axis of the cylinder.

20 Claims, 12 Drawing Sheets

(51) Int. Cl.
*F02B 25/14* (2006.01)
*F02B 63/02* (2006.01)

(56) References Cited

U.S. PATENT DOCUMENTS

| | | | | |
|---|---|---|---|---|
| 7,025,021 | B1 * | 4/2006 | Andersson | F02B 25/14 123/65 W |
| 7,210,433 | B2 * | 5/2007 | Mavinahally | F01L 7/06 123/73 A |
| 2003/0029398 | A1 * | 2/2003 | Andersson | F02B 25/14 123/73 PP |

FOREIGN PATENT DOCUMENTS

| | | |
|---|---|---|
| JP | 56-018021 | 2/1981 |
| JP | 2001-012249 | 1/2001 |
| JP | 2002-227652 | 8/2002 |
| JP | 2002-227653 | 8/2002 |
| JP | 2002-535546 | 10/2002 |
| JP | 2011-127601 | 6/2011 |
| WO | 00/43650 | 7/2000 |
| WO | 2010/035684 | 4/2010 |

OTHER PUBLICATIONS

U.S. Appl. No. 14/261,945 to Kenji Imafuku et al., which was filed on Apr. 25, 2014.
Japanese Office Action for JP App. No. 2013-095198 mailed on Jul. 26, 2016, along with English-language translation thereof.

* cited by examiner

STRATIFIED SCAVENGING TWO-STROKE ENGINE

CROSS-REFERENCE TO RELATED APPLICATION

The application claims priority on Japanese Patent Application No. 2013-095198, filed on Apr. 30, 2013, the entire contents of which are incorporated herein by reference.

BACKGROUND OF THE INVENTION

1. Field of the Invention

The present invention relates to a stratified scavenging two-stroke engine of an air-leading type, which uses pre-scavenging by air.

2. Description of Related Art

In a stratified scavenging two-stroke engine of an air-leading type, during an upward stroke of a piston, a gaseous mixture is introduced from an intake passage into a crankcase and air is introduced from an air passage into a scavenging passage by a negative pressure formed in the crankcase. Further, during a downward stroke of the piston, the air that has been introduced into the scavenging passage during the upward stroke is introduced into the cylinder as air for pre-scavenging prior to introduction of the gaseous mixture from the crankcase into the cylinder. Consequently, since a layer of air is present between a combustion gas of the gaseous mixture and a gaseous mixture that is newly supplied through the scavenging passage, it is possible to prevent the gaseous mixture from being mixed into the combustion gas, and to thereby prevent blow-by of an unburned gas through an exhaust passage. Japanese Laid-open (Kokai) Patent Application Publication No. 2011-127601 discloses an example of this type of stratified scavenging two-stroke engine.

In addition, such a stratified scavenging two-stroke engine is employed as an engine of a portable working machine (including a handheld working machine and a backpack working machine) such as a chainsaw. In recent years, downsizing of such a portable working machine is increasingly required, and along with this requirement, downsizing of a stratified scavenging two-stroke engine being an engine of such a working machine is also required.

In the stratified scavenging two-stroke engine disclosed in Japanese Laid-open (Kokai) Patent Application Publication No. 2011-127601, a gaseous mixture passage (intake passage) and a supply passage (air passage) are arranged in vertical direction along the axis of cylinder. For this reason, it is difficult to reduce the size of the engine in the vertical direction (cylinder axis direction), and there is a room for improvement in this respect.

Under the circumstances, it is an object of the present invention to provide a stratified scavenging two-stroke engine that can achieve downsizing of the entire engine, particularly in vertical direction (cylinder axis direction).

SUMMARY OF THE INVENTION

In order to achieve the above objects, an aspect of the present invention provides a stratified scavenging two-stroke engine which includes a cylinder member in which a cylinder housing a piston is formed, and a crankcase, or a crankcase-forming member forming a part of the crankcase, joined with the cylinder member, the engine including: an intake passage that connects an intake that opens through an outer surface of the cylinder member with an intake port that opens to the inside of the cylinder according to movement of the position of the piston, and supplies a gaseous mixture of fuel and air to the inside of the crankcase; an exhaust passage that connects an exhaust outlet that opens through the outer surface of the cylinder member with an exhaust port that opens to the inside of the cylinder according to movement of the position of the piston, and discharges a combustion gas inside of the cylinder; a scavenging passage that connects a scavenging intake that opens to the inside of the crankcase with a scavenging port that opens to the inside of the cylinder according to movement of the position of the piston; and an air passage that connects an air inlet that opens through the outer surface of the cylinder member with the scavenging passage and supplies air for pre-scavenging into the scavenging passage. The intake and the air inlet are arranged at positions opposite from the exhaust outlet across an axis of the cylinder, and the intake and the air inlet are arranged side by side in a substantially circumferential direction of the cylinder or a direction substantially perpendicular to the axis of the cylinder.

Other objects and features of aspects of the present invention will be understood from the following description with reference to the accompanying drawings.

DESCRIPTION OF PREFERRED EMBODIMENTS

Hereinbelow, embodiments of the present invention will be described with reference to the accompanying drawings.

A stratified scavenging two-stroke engine according to the embodiments (hereinafter simply referred to as the "engine") is a single-cylinder compact two-stroke engine which can be used as an engine (a driving source) for a portable working machine such as a chainsaw. The engine of the embodiments is a transverse engine transversely accommodated in e.g. a main body of a top handle saw. However, the present invention is not limited thereto, and it can be applied also to a vertical engine. As used herein, regardless of the direction in which the engine is disposed, the axis direction of a cylinder is designated as a vertical direction and a direction in which a piston leaves from a crankshaft is designated as an upward direction, and a direction in which the piston approaches the crankshaft is designated as a downward direction.

First Embodiment

Figure 1:
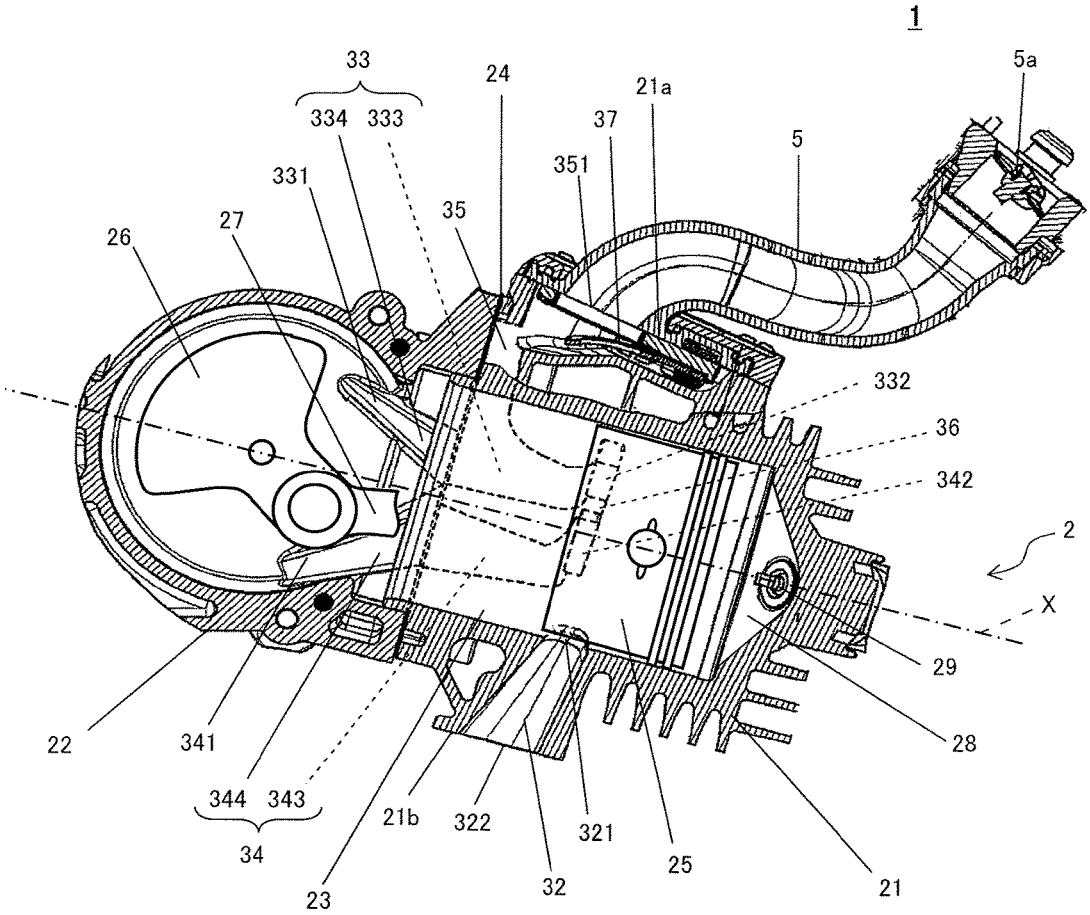
FIG. 1 is a cross-sectional view of a stratified scavenging two-stroke engine according to a first embodiment.
Figure 2:
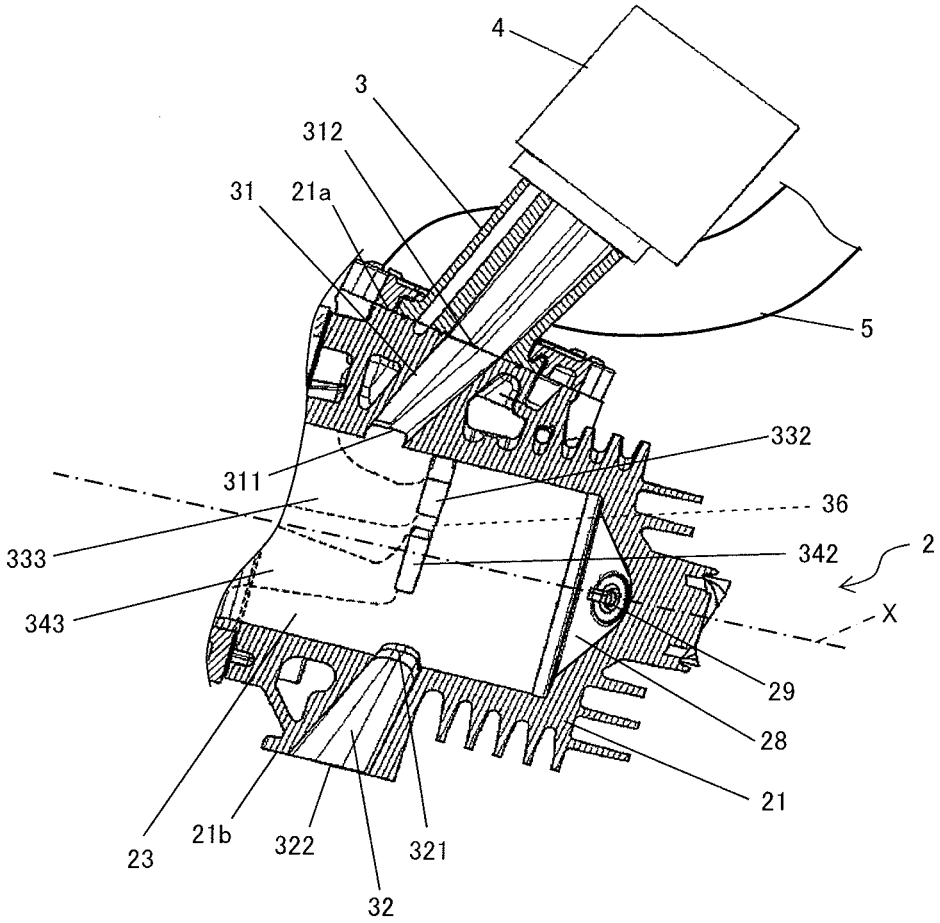
FIG. 2 is also a cross-sectional view of the stratified scavenging two-stroke engine according to the first embodiment.

FIGS. 1 and 2 are cross-sectional views illustrating the construction of an engine 1 according to a first embodiment of the present invention (here, a part of components are omitted in FIG. 2). As illustrated in FIGS. 1 and 2, the engine 1 includes an engine main body 2, an intake pipe 3, a carburetor 4 that is a fuel addition device, and an air duct 5.

The engine main body 2 has a cylinder member 21 and a crankcase 22. The cylinder member 21 has a cylinder 23 having an axis X formed therein. The crankcase 22 is joined with a lower portion of the cylinder member 21 (left side in FIGS. 1 and 2), and in a joining portion between the cylinder member 21 and the crankcase 22, a gasket 24 being an interposed member is disposed.

The cylinder 23 houses a piston 25 so that the piston 25 can reciprocate along the axis X, and the crankcase 22 houses a crankshaft 26 so as to be rotatable. The piston 25 and the crankshaft 26 are joined with each other via a connecting rod 27 (only a broken part of which is illustrated), so that the up-down movement of the piston 25 is converted to rotational movement of the crankshaft 26. The crankshaft 26 has one end extending to the outside of the crankcase 22, so that the rotational movement of the crankshaft 26 can be taken out as an output of the engine 1.

In the cylinder 23, a combustion chamber 28 is formed above the piston 25, and in the combustion chamber 28, an ignition plug 29 is provided. The ignition plug 29 operates to ignite a gaseous mixture in the combustion chamber 28 when the piston 25 is at the top dead center or its vicinity.

In the engine main body 2, there are formed an intake passage 31 (refer to FIG. 2) that supplies a gaseous mixture of fuel and air to the inside of the crankcase 22, an exhaust passage 32 that discharges combustion gas in the cylinder 23, scavenging passages (first scavenging passage 33 and second scavenging passage 34) connecting the inside of the crankcase 22 and the inside of the cylinder 23, and an air passage 35 that supplies air into the scavenging passage (first scavenging passage 33 in this embodiment). Here, the term "inside of the crankcase 22" basically means an inner space of the crankcase 22, but it means a space including both the inner space of the crankcase 22 and an inner space of the cylinder 23 below the piston 25 in some cases.

Now the passages will be described in detail.

The intake passage 31 is, as illustrated in FIG. 2, formed in the cylinder member 21 and communicates with the inside of the cylinder 23 via an intake port 311. Specifically, the intake passage 31 connects the intake port 311 and an intake 312 opening through the outer surface of the cylinder member 21. In this embodiment, the intake 312 opens through a first flat portion 21*a* being a portion of the outer surface of the cylinder member 21 formed substantially in a flat shape. To this first flat portion 21*a*, an intake pipe 3 communicating with the intake 312 is attached, and to the intake pipe 3, a carburetor 4 is provided. The carburetor 4 adds a fuel to air introduced from the outside, to produce a gaseous mixture.

The upper edge of the intake port 311 is located below an upper surface of the piston 25 when it is at the bottom dead center, and the lower edge of the intake port 311 is located below a lower surface of the piston 25 when it is at the top dead center. Specifically, the intake port 311 is closed by the piston 25 when the piston 25 is at the bottom dead center, and opens to the inside of the cylinder 23 below the piston 25 in a period from the middle stage of the upward stroke to the middle stage of the downward stroke of the piston 25.

By this configuration, the intake passage 31 supplies the gaseous mixture produced in the carburetor 4 to the inside of the crankcase 22 by a negative pressure formed inside of the crankcase 22 during the upward stroke of the piston 25, more specifically, in a period from the middle stage of the upward stroke in which the intake port 311 opens to the inside of the cylinder 23 below the piston 25. Here the upward stroke of the piston 25 means a stroke in which the piston 25 moves from the bottom dead center toward the top dead center, and the downward stroke of the piston 25 means a stroke in which the piston 25 moves from the top dead center toward the bottom dead center.

The exhaust passage 32 is, as illustrated in FIGS. 1 and 2, formed in the cylinder member 21 and communicates with the inside of the cylinder 23 via an exhaust port 321. Specifically, the exhaust passage 32 connects the exhaust port 321 and an exhaust outlet 322 opening through the outer surface of the cylinder member 21. In this embodiment, the exhaust outlet 322 opens through a second flat portion 21*b* being a portion of the outer surface of the cylinder member 21 formed substantially in a flat shape. Here, the first flat portion 21*a* through which the intake 312 opens and the second flat portion 21*b* through which the exhaust outlet 322 opens are located at positions substantially opposed to each other across (the axis X of) the cylinder 23. Here, although omitted in FIGS. 1 and 2, an exhaust muffler is attached to the second flat portion 21*b*.

The upper edge of the exhaust port 321 is located above an upper surface of the piston 25 when it is at the bottom dead center, and the lower edge of the exhaust port 321 is located above a lower surface of the piston 25 when it is at the top dead center. Specifically, the exhaust port 321 is closed by the piston 25 when the piston 25 is at the top dead center, and opens to the inside of the cylinder 23 above the piston 25 in a period from the middle stage of the downward stroke to the middle stage of the upward stroke of the piston 25.

By this configuration, the exhaust passage 32 discharges the combustion gas in the cylinder 23 during the downward stroke of the piston 25, more specifically, in a period from the middle stage of the downward stroke in which the exhaust port 321 opens to the inside of the cylinder 23 above the piston 25.

The first scavenging passage 33 and the second scavenging passage 34 have, as illustrated in FIG. 1, ends communicating with the inside of the crankcase 22 via scavenging intakes 331 and 341, respectively, and the other ends communicating with the inside of the cylinder 23 via scavenging ports 332 and 342, respectively, so as to spatially connect the inside of the crankcase 22 with the inside of the cylinder 23.

Specifically, the first scavenging passage 33 extends upwardly from the first scavenging intake 331 formed in the crankcase 22, and is connected to the first scavenging port 332 formed in the cylinder member 21. The first scavenging passage 33 has a cylinder member-side passage 333 above the joining portion of the cylinder member 21 with the crankcase 22, and a crankcase-side passage 334 below the joining portion. In the same manner, the second scavenging passage 34 extends upwardly from the second scavenging intake 341 formed in the crankcase 22, and is connected to the second scavenging port 342 formed in the cylinder member 21. The second scavenging passage 34 has a cylinder member-side passage 343 above the joining portion, and a crankcase-side passage 344 below the joining portion.

In this embodiment, one set of the first scavenging intake 331, the first scavenging port 332, the second scavenging intake 341 and the second scavenging port 342, is formed on each side across the axis X of the cylinder 23, and so as to correspond to them, one set of the first scavenging passage 33 (cylinder member-side passage 333, crankcase-side passage 334) and the second scavenging passage 34 (cylinder member-side passage 343, crankcase-side passage 344) is also formed on each side across the cylinder 23. Here, in FIGS. 1 and 2, only the first scavenging passage 33, the second scavenging passage 34, the first scavenging intake 331, the first scavenging port 332, the second scavenging intake 341 and the second scavenging port 342, on one side are illustrated.

Figure 3A:
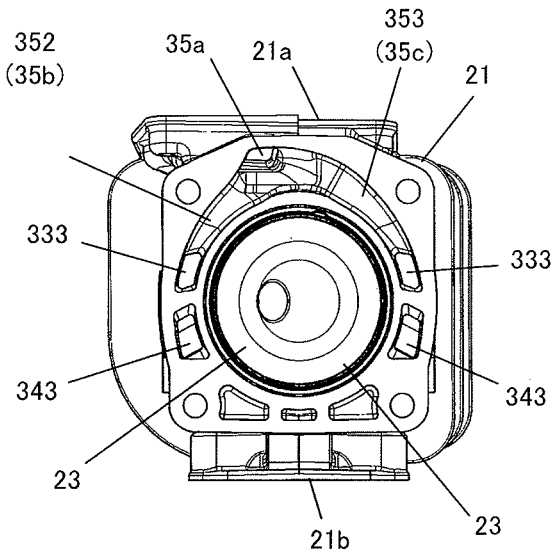
FIGS. 3A and 3B are views of a cylinder member observed from a position facing to a joining surface with a crankcase (cylinder base surface).
Figure 3B:
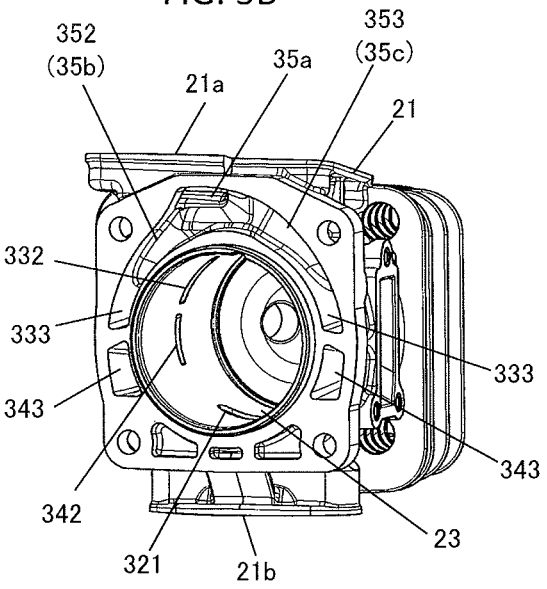
Figure 4A:
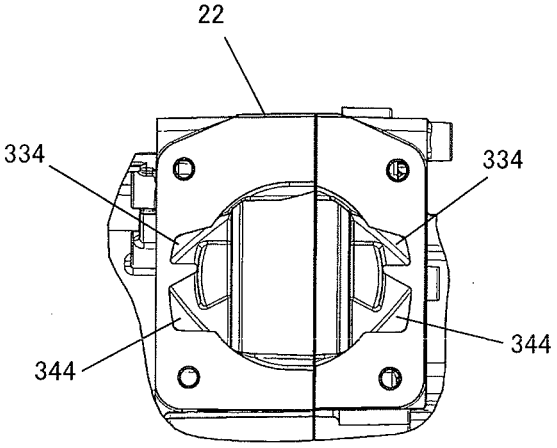
FIGS. 4A and 4B are views of the crankcase observed from a position facing to a joining surface with the cylinder member (crankcase base surface).
Figure 4B:
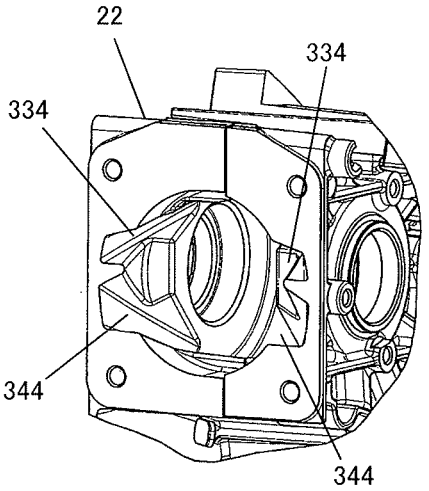
Figure 5A:
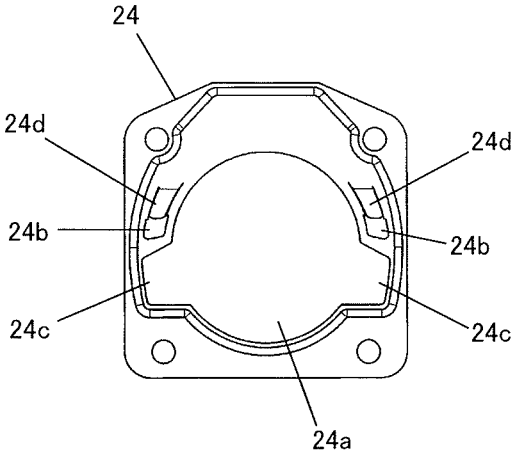
FIGS. 5A and 5B are views illustrating an example of a gasket interposed (disposed) at a joining portion between the cylinder member and the crankcase.
Figure 5B:
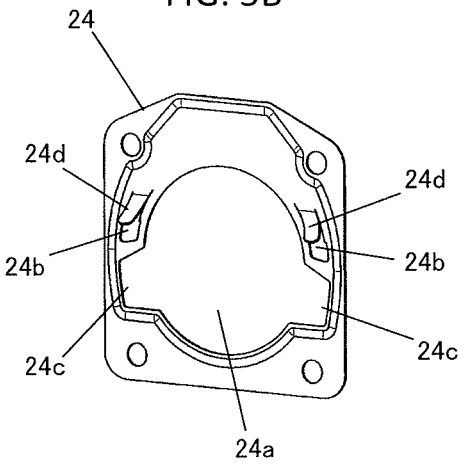

FIGS. 3A and 3B are views of the cylinder member 21 observed from a position facing to a joining surface (hereinafter referred to as "cylinder base surface") with the crankcase 22. FIGS. 4A and 4B are views of the crankcase 22 observed from a position facing to a joining surface (hereinafter referred to as "crankcase base surface") with the cylinder member 21. FIGS. 5A and 5B are views illustrating a gasket 24 interposed (disposed) between these surfaces (that are the cylinder base surface and the crankcase base surface).

As illustrated in FIGS. 3A and 3B, the cylinder member-side passage 333 of the first scavenging passage 33 and the cylinder member-side passage 343 of the second scavenging passage 34 are formed in the side wall of the cylinder member 21. Further, as illustrated in FIGS. 4A and 4B, the crankcase-side passage 334 of the first scavenging passage 33 and the crankcase-side passage 344 of the second scavenging passage 34 are formed as concave portions of an inner surface of the crankcase 22. Further, as illustrated in FIG. 5, in the gasket 24 disposed between the cylinder base surface and the crankcase base surface, there are formed a center hole 24*a* corresponding to the cylinder 23, a pair of communication holes (corresponding to "first opening" of the present invention) 24*b* arranged across the center hole 24*a*, and a pair of cutout holes (corresponding to "second opening" of the present invention) 24*c* arranged across the center hole 24*a*.

Then, the inside of the crankcase 22 and the inside of the cylinder 23 communicate with each other via the center hole 24*a* formed in the gasket 24; the cylinder member-side passage 333 and the crankcase-side passage 334 of the first scavenging passage 33 communicate with each other via the communication hole 24*b* formed in the gasket 24; and the cylinder member-side passage 343 and the crankcase-side passage 344 of the second scavenging passage 34 communicate with each other via the cutout hole 24*c* formed in the gasket 24.

Here, in this embodiment, the cross-sectional area of the crankcase-side passage 344 (and the area of the cutout hole 24*c* of the gasket 24) of the second scavenging passage 34 is formed to be larger than the cross-sectional area of the crankcase-side passage 334 (and the area of the communication hole 24*b* of the gasket 24) of the first scavenging passage 33.

Returning to FIGS. 1 and 2, the first scavenging port 332 and the second scavenging port 342 are formed adjacently to each other with a predetermined distance in a circumferential direction of the cylinder 23. That is, the first scavenging port 332 and the second scavenging port 342 form respective independent openings.

The upper edges of the first scavenging port 332 and the second scavenging port 342 are located above the upper surface of the piston 25 when it is at the bottom dead center, and their lower edges are located above the lower surface of the piston 25 when it is at the top dead center. Further, the upper edges of the first scavenging port 332 and the second scavenging port 342 are located below the upper edge of the exhaust port 321. Specifically, the first scavenging port 332 and the second scavenging port 342 open to the inside of the cylinder 23 above the piston 25 in a final stage of the downward stroke of the piston 25, in other words, after the exhaust port 321 opens to the inside of the cylinder 23 above the piston 25. Furthermore, the first scavenging port 332 and the second scavenging port 342 are closed by the piston 25 in a period other than the final stage of the downward stroke and an initial stage of the upward stroke of the piston 25.

By this configuration, in the downward stroke of the piston 25 (more specifically, on and after the final stage of the downward stroke), the first scavenging passage 33 and the second scavenging passage 34 make the inside of the crankcase 22 communicate with the inside of the cylinder 23 to form a gaseous mixture-supplying passage, that supplies a gaseous mixture from the crankcase 22 into the inside of the cylinder 23.

The cylinder member-side passage 333 of the first scavenging passage 33 and the cylinder member-side passage 343 of the second scavenging passage 34 communicate with each other via a communicating portion 36 formed in the cylinder member 21. In this embodiment, the communicating portion 36 is formed in a region outside the first scavenging port 332 and the second scavenging port 342 in the cylinder member 21.

The air passage 35 is, as illustrated in FIG. 1, formed in the cylinder member 21 and connected to the first scavenging passage 33. Specifically, the air passage 35 connects an air inlet 351 opening through the outer surface of the cylinder member 21 and the cylinder member-side passage 333 of the first scavenging passage 33. In this embodiment, the air inlet 351 opens through the first flat portion 21*a*.

Figure 6A:
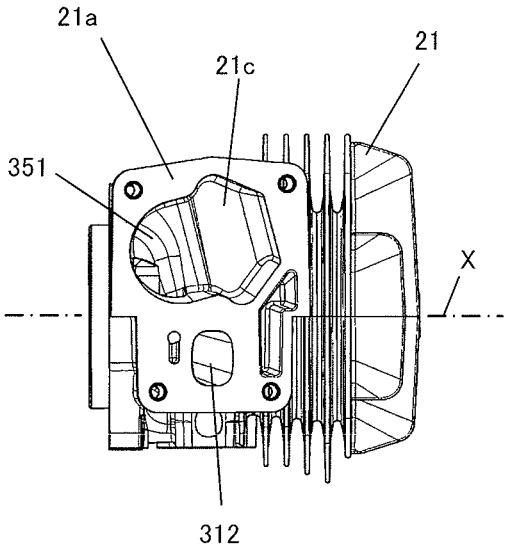
FIGS. 6A and 6B are views of a cylinder member observed from a position facing to an end surface through which an intake and an air inlet open.
Figure 6B:
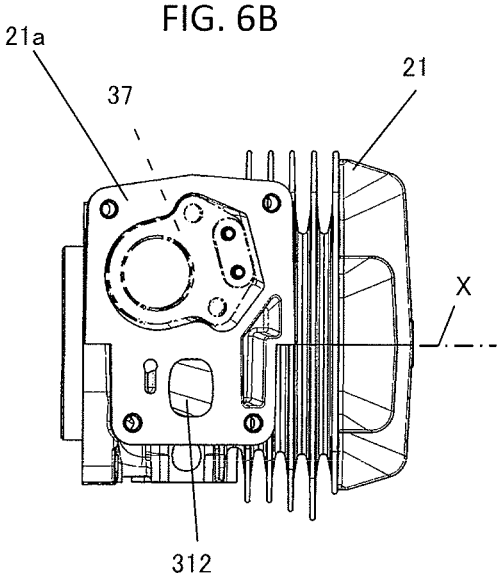

FIGS. 6A and 6B are views of the cylinder member 21 observed from the first flat portion 21*a* side. As illustrated in FIGS. 6A and 6B, in this embodiment, the intake 312 and the air inlet 351 open through a common flat portion (that is the first flat portion 21*a*) on the outer surface of the cylinder member 21, and the intake 312 and the air inlet 351 are arranged side by side (adjacent to each other) in a direction substantially perpendicular to the axis X of the cylinder 23.

As described above, one cylinder member-side passage 333 of the first scavenging passage 33 is formed on each side of the cylinder 23. Accordingly, in this embodiment, the air passage 35 extends from the air inlet 351 and branches, and the branched passages extend in different directions along the outer circumference of the cylinder 23 and reach respective cylinder member-side passages 333 of the first scavenging passages 33. Specifically, as illustrated in FIGS. 3A and 3B and FIGS. 5A and 5B, the air passage 35 includes an inner passage 35*a* penetrating through a side wall of the cylinder member 21, and branched passages 35*b*, 35*c* constituted by passage grooves 352, 353 formed on the cylinder base surface so as to be connected with the inner passage 35*a* and (an upper surface of) the gasket 24. That is, in this embodiment, the upper surface of the gasket 24 constitutes a part of the air passage 35. Further, in this embodiment, as illustrated in FIGS. 3A and 3B, the branched passages 35*b*, 35*c* (passage grooves 352, 353) of the air passage 35 are formed (arranged) asymmetrically across the cylinder 23.

Here, as illustrated in FIGS. 5A and 5B, the gasket 24 is provided with guide portions 24*d* extending to points above the communication holes 24*b*. In this embodiment, the guide portions 24*d* are each formed so as to gradually ascend from the upper surface of the gasket 24 toward the tip of the guide portion 24*d*, so that air passed through the branched passages 35*b*, 35*c* of the air passage 35 (that is, air passing along upper surfaces of the gasket 24) is guided toward the cylinder member-side passage 333 of the first scavenging passage 33. By this configuration, a greater amount of the air passed through the branched passages of the air passage 35 flows into the cylinder member-side passage 333 of the first scavenging passage 33 (in other words, the air hardly flows into the crankcase-side passages 334).

As illustrated in FIG. 1, the air passage 35 is provided with a check valve 37 which allows a flow from the air passage 35 toward the first scavenging passage 33 (its cylinder member-side passage 333) and inhibits a flow in the opposite direction. In this embodiment, a reed valve is employed as the check valve 37, and the reed valve is, as illustrated in FIGS. 6A and 6B, attached to a concave portion 21*c* formed in the first flat portion 21*a* of the cylinder member 21.

Further, as illustrated in FIG. 1, to the first flat portion 21*a* of the cylinder member 21, an air duct 5 communicating with the air inlet 351 is attached via the check valve (reed valve) 37, and the air duct 5 is provided with an air adjustment valve 5*a* that adjusts flow rate of air passing through the air duct 5. Here, the air adjustment valve 5*a* is configured to allow interlock with a fuel adjustment valve (not illustrated) in a carburetor 4, for adjusting flow rate of fuel.

Here, to the first flat portion 21*a* of the cylinder member 21 through which the intake 312 and the air inlet 351 open, the intake pipe 3 and the air duct 5 may be attached after they are integrated together by e.g. an attachment, or the intake pipe 3 and the air duct 5 may be individually attached.

Figure 7:
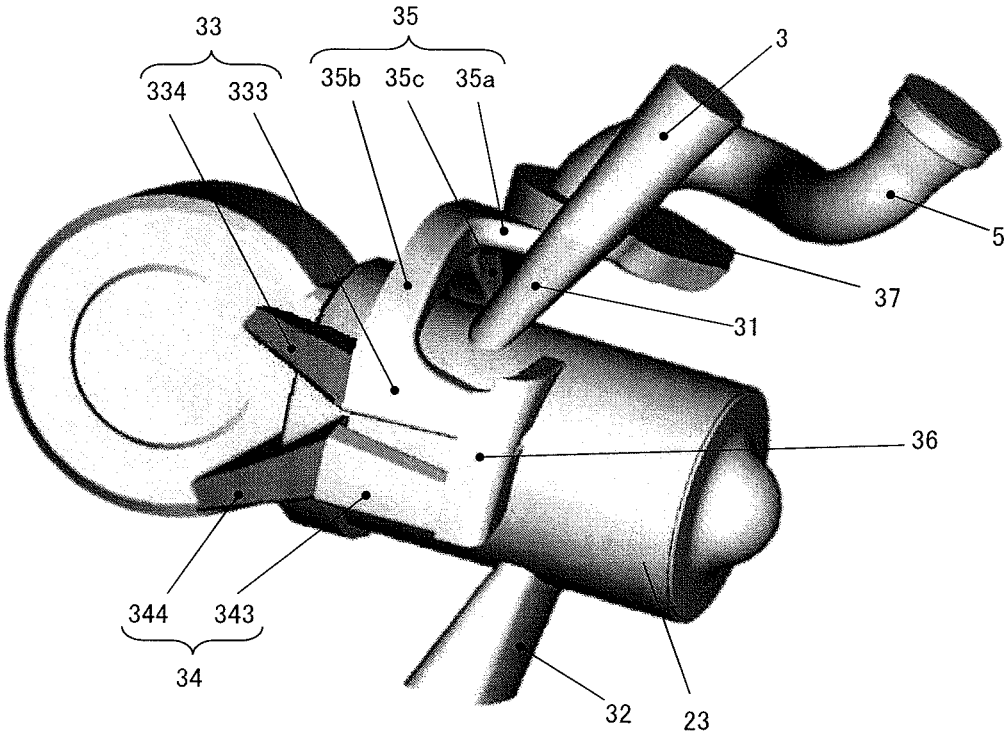
FIG. 7 is a schematic view illustrating passages of the stratified scavenging two-stroke engine according to the first embodiment.

FIG. 7 is a schematic view illustrating passages of the engine 1.

The engine 1 of this embodiment is provided with a pair of first scavenging passages 33 (cylinder member-side passages 333 and crankcase-side passages 334) and a pair of second scavenging passages 34 (cylinder member-side passages 343 and crankcase-side passages 344) arranged across the cylinder 23, and such a first scavenging passage 33 and such a second scavenging passage 34 communicate with each other via the communicating portion 36. Further, the air passage 35 is constituted by the inner passage 35*a* passing through a side wall of the cylinder member 21, and the branched passages 35*b*, 35*c* extending in different directions from each other along an outer circumference of the cylinder 23 on the cylinder base surface, and end portions of the branched passages 35*b*, 35*c* are connected to respective cylinder member-side passages 333 of the first scavenging passage 33. Further, the air passage 35 is provided with the check valve (reed valve) 37 which allows a flow from the air passage 35 toward the first scavenging passage 33 and inhibits a flow in the opposite direction.

Next, operation of the engine 1 of this embodiment will be described.

When the piston 25 present at the bottom dead center starts to move toward the top dead center, a negative pressure is formed inside of the crankcase 22, and the negative pressure is developed along with ascending of the piston 25. The negative pressure formed inside of the crankcase 22 is propagated from the first scavenging intake 331 and the second scavenging intake 341 opening to the inside of the crankcase 22 through the first scavenging passage 33 and the second scavenging passage 34 toward the first scavenging port 332 and the second scavenging port 342, respectively.

In the middle stage of the upward stroke of the piston 25, when the pressure in the first scavenging passage 33 becomes lower than atmospheric pressure by the negative pressure developed inside of the crankcase 22, the check valve (reed valve) 37 provided in the air passage 35 opens. Consequently, air is introduced from the air duct 5 into the first scavenging passage 33 (cylinder member-side passage 333) through the air passage 35, and air is also introduced through the communicating portion 36 into the second scavenging passage 34 (cylinder member-side passage 343). This introduction of air continues until the final stage of the upward stroke of the piston 25 to fill most of the first scavenging passage 33 and the second scavenging passage 34 with air. Meanwhile, when the piston 25 passes the intake port 311, the intake port 311 opens to the inside of the cylinder 23 below the piston 25, and the negative pressure inside of the crankcase 22 is propagated via the intake port 311 to the intake passage 31. This causes external air to be drawn into the carburetor 4, and a gaseous mixture of the taken air and a fuel added by the carburetor 4 is introduced via the intake passage 31 into the crankcase 22.

Then, when the piston 25 further ascends to reach the top dead center or its vicinity, an ignition plug 29 operates to ignite the gaseous mixture in a combustion chamber 28 to burn the gaseous mixture. This gaseous mixture is one that has been supplied to the inside of the cylinder 23 in a previous cycle (supply of the gaseous mixture into the cylinder 23 will be described later). The piston 25 is pushed down by volume expansion of the fuel (that is, the operation transits to the downward stroke), to rotate the crankshaft 26 via the connecting rod 27. This rotation of the crankshaft 26 is taken out as an output of the engine 1.

In the middle stage of the downward stroke of the piston 25, when the piston 25 passes the exhaust port 321, the exhaust port 321 opens to the inside of the cylinder 23 above the piston 25, and a combustion gas (burned gas of gaseous mixture) inside of the cylinder 23 is discharged to the exhaust passage 32. This cause rapid drop in pressure inside of the cylinder 23. Meanwhile, inside of the crankcase 22, the gaseous mixture is compressed by descend of the piston 25, which causes to raise the pressure inside of the crankcase 22. When the pressure inside of the crankcase 22 becomes higher than the pressure in the first scavenging passage 33 and the second scavenging passage 34, the gaseous mixture inside of the crankcase 22 flows from the first scavenging intake 331 to the first scavenging passage 33, and the gaseous mixture flows from the second scavenging intake 341 to the second scavenging passage 34. In this middle stage of the downward stroke, since the first scavenging port 332 and the second scavenging port 342 are closed by the piston 25, the gaseous mixture that has flowed into the first scavenging passage 33 and the second scavenging passage 34 compresses the air that has flowed into the first scavenging passage 33 and the second scavenging passage 34 in the preceding upward stroke. Here, the check valve (reed valve) 37 provided in the air passage 35 prevents the air or the gaseous mixture in the first scavenging passage 33 from flowing out to the air passage 35.

In the final stage of the downward stroke of the piston 25, when the piston 25 passes the first scavenging port 332 and the second scavenging port 342, the first scavenging port 332 and the second scavenging port 342 open to the inside of the cylinder 23 above the piston 25. Consequently, air in the first scavenging passage 33 and the second scavenging passage 34 flows into the cylinder 23 via the first scavenging port 332 and the second scavenging port 342, respectively. By this air that has flowed into the cylinder 23, combustion gas remaining in the cylinder 23 is scavenged and discharged to the exhaust passage 32 (that is, pre-scavenging by air). Subsequently, a gaseous mixture in the first scavenging passage 33 and the second scavenging passage 34 and a gaseous mixture inside of the crankcase 22 flows (is supplied) into the cylinder 23, and by the gaseous mixture that has flowed (supplied) into the cylinder 23, a combustion gas remaining inside of the cylinder 23 even after the pre-scavenging and air that has flowed into the cylinder 23 earlier are scavenged. Here, since a layer of air is present between the combustion gas and the gaseous mixture, it is possible to prevent the gaseous mixture (unburned gas) from flowing out (blowing-by) into the exhaust passage 32 at a time of scavenging.

Thereafter, when the piston 25 reaches the bottom dead center, the operation transits to the upward stroke of the piston 25 of the next cycle. In this upward stroke of the piston 25 of the next cycle, even after the first scavenging port 332 and the second scavenging port 342 are closed by the piston 25, the exhaust port 321 is still open to the inside of the cylinder 23 in a predetermined period and the air inside of the cylinder 23 is continuously scavenged in this period. Then, when the piston 25 further ascends and the exhaust port 321 is closed by the piston 25, the inside of the cylinder 23 is hermetically closed, and compression of the gaseous mixture starts.

In the engine 1 of this embodiment, the intake 312 and the air inlet 351 are arranged side by side in a direction substantially perpendicular to the axis X of the cylinder 23, and they are arranged at positions opposite from the exhaust outlet 322 across the axis X of the cylinder 23. Accordingly, it is possible to reduce the size of the engine 1 in the vertical direction, and to downsize the entire engine 1.

Further, since the intake 312 and the air inlet 351 open through the same flat portion 21*a* of an outer surface of the cylinder member 21, for example, the intake pipe 3 and the air duct 5 may be integrated together by e.g. an attachment before they are attached to the engine main body 2 (cylinder member 21). Accordingly, it is possible to improve efficiency of assembly work of the engine 1.

Further, the scavenging passage (first scavenging passage 33, second scavenging passage 34) has a cylinder member-side passage 333, 343 and a crankcase-side passage 334, 344, and they communicate with each other via an opening (communication hole 24*b*, 24*c*) of the gasket 24 provided in a joining portion between the cylinder member 21 and the crankcase 22. By this configuration, it is possible to obtain a sufficient amount of air for pre-scavenging, and to form the scavenging passages (first scavenging passage 33 and second scavenging passage 34) without projecting these passages outwardly from the cylinder member 21 and the crankcase 22, and to thereby downsize the engine 1 also in this respect.

Further, since the upper surface of the gasket 24 constitutes a part of the air passage 35 connected to the cylinder member-side passage 333 of the first scavenging passage 33, and the gasket 24 has guide portions 24*d* formed for guiding air, that is flowing along the upper surface of the gasket 24, toward the cylinder member-side passages 333 of the first scavenging passages 33. This configuration facilitates production of the cylinder member 21, and enables downsizing of the engine 1 (particularly in the size of the cylinder member 21) since it is unnecessary to form the entire air passage 35 in a side wall of the cylinder member 21. Further, this configuration helps air, that has been introduced from the air passage 35, to flow through the cylinder member-side passages 333 of the first scavenging passages 33 and the communicating portions 36 into the second scavenging passages 34, and suppresses flow of air from the air passage 35 into the crankcase-side passages 334 of the first scavenging passages 33.

Second Embodiment

Next, an engine according to a second embodiment of the present invention will be described. Here, in the following description, elements common to those of the first embodiment are indicated by the same symbols and their explanations are omitted.

Figure 8:
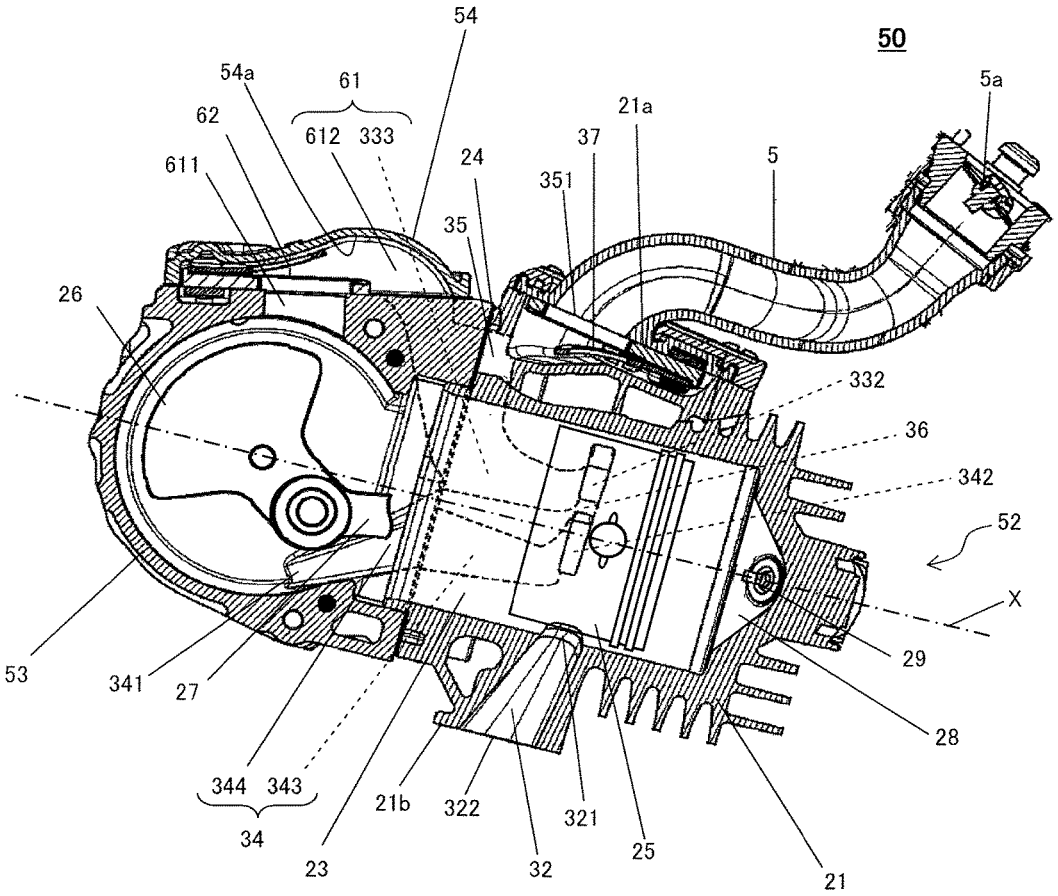
FIG. 8 is a cross-sectional view of a stratified scavenging two-stroke engine according to a second embodiment.
Figure 9:
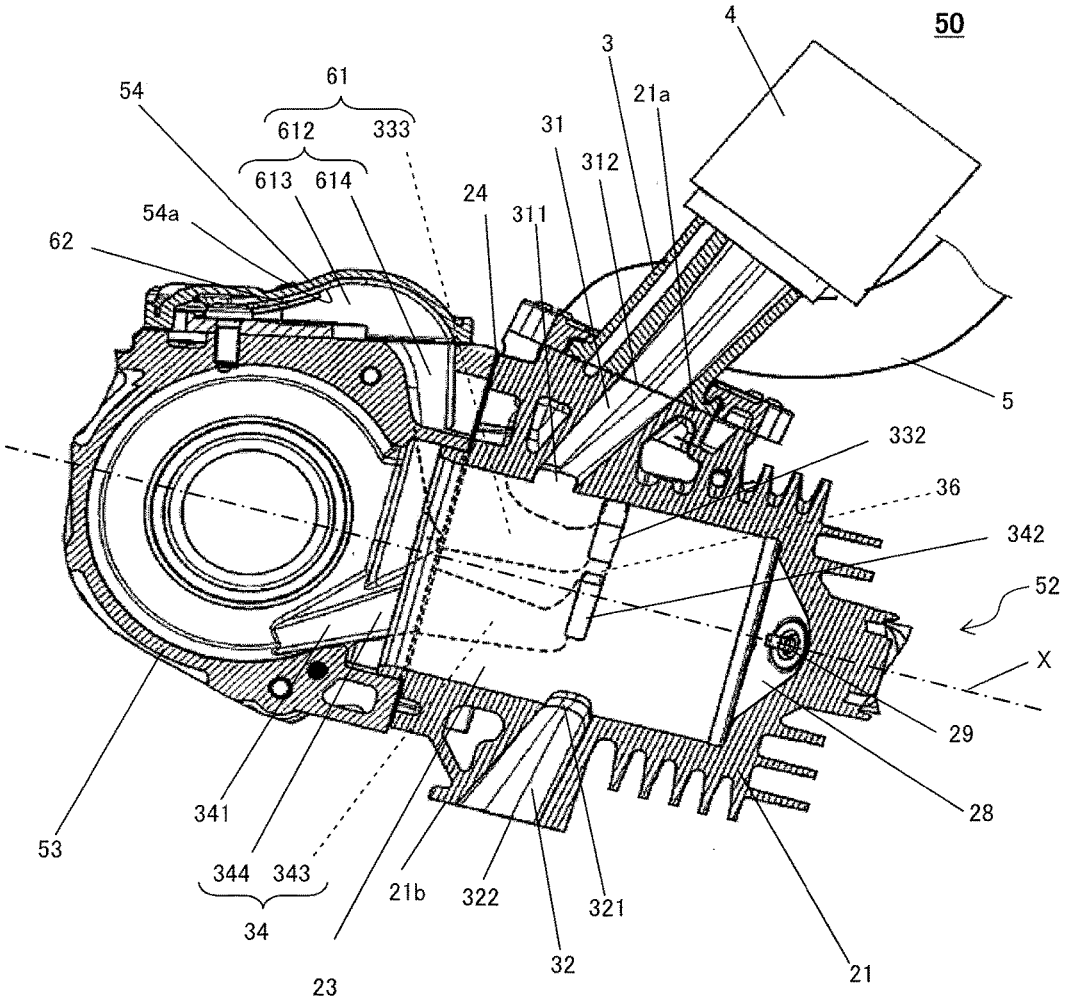
FIG. 9 is also a cross-sectional view of the stratified scavenging two-stroke engine according to the second embodiment.

FIGS. 8 and 9 are cross-sectional views of an engine 50 according to the second embodiment of the present invention (here, a part of components are omitted in FIG. 9). As illustrated in FIGS. 8 and 9, the engine 50 includes an engine main body 52, an intake pipe 3, a carburetor 4 and an air duct 5.

The engine main body 52 has a cylinder member 21, a crankcase 53 and a crankcase cover 54. The cylinder member 21 has a cylinder 23 having an axis X formed therein. The crankcase 53 is joined with a lower portion of the cylinder member 21 (left side in FIGS. 8 and 9), and the crankcase cover 54 is fixed to a side portion (upper side in FIGS. 8 and 9) of the crankcase 53. In a joining portion between the cylinder member 21 and the crankcase 53, a gasket 24 is interposed.

In the engine main body 52, there are formed an intake passage 31 (refer to FIG. 9), an exhaust passage 32, scavenging passages (first scavenging passage 61 and second scavenging passage 34) connecting the inside of the crankcase 53 and the inside of the cylinder 23, and an air passage 35 that supplies air into the scavenging passage (first scavenging passage 61). Passages other than the first scavenging passage 61 are basically similar to those of the first embodiment.

The first scavenging passage 61 extends upwardly in an S-shape from a first scavenging intake 611 formed in the crankcase 53, and is connected to a first scavenging port 332 formed in the cylinder member 21. The first scavenging passage 61 has cylinder member-side passages 333 above the joining portion between the cylinder member 21 and the crankcase 53, and a crankcase-side passage 612 below the joining portion. In this embodiment, the crankcase-side passage 612 is constituted by a case-outside passage portion 613 formed by an inner surface 54*a* of the crankcase cover 54 outside the crankcase 53, and a case-inside passage portion 614 formed in a side wall of the crankcase 53 (refer to FIG. 9).

Here, in this embodiment, a single first scavenging intake 611 is formed so as to penetrate through a side portion of the crankcase 53, and two first scavenging ports 332 are formed on respective sides across the axis X of the cylinder 23. Accordingly, the first scavenging passage 61 has two cylinder member-side passages 333 formed on respective sides across the cylinder 23, and the crankcase-side passage 612 including the case-inside passage portion 614 branched into passages extending in different directions along the outer circumference of the cylinder 23 and having their ends connected to respective cylinder member-side passages 333.

Figure 10A:
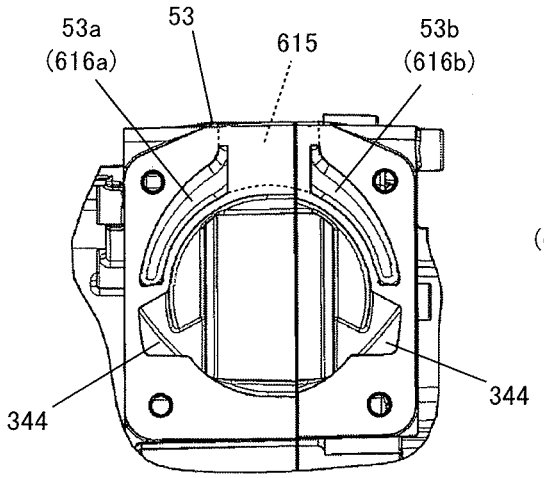
FIGS. 10A and 10B are views of a crankcase according to the second embodiment observed from a position facing to a joining surface with a cylinder member (crankcase base surface).
Figure 10B:
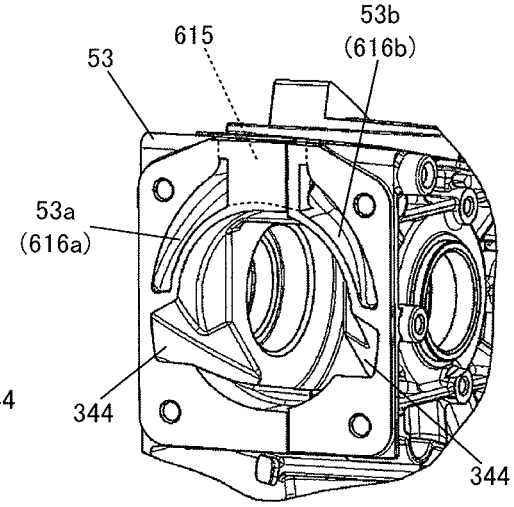

FIGS. 10A and 10B are views of the crankcase 53 observed from a position facing to a joining surface with the cylinder member 21 (crankcase base surface) (refer to FIGS. 3A, 3B, 5A and 5B for cylinder member 21 and gasket 24).

In this embodiment, the case-inside passage portion 614 of the crankcase-side passage 612 includes an inner passage 615 (indicated by broken lines) penetrating through the side wall of the crankcase 53, passage grooves 53*a*, 53*b* formed along the crankcase base surface so as to be connected to the inner passage 615, and branched passages 616*a*, 616*b* constituted by (a lower surface of) the gasket 24. Then, end portions (edges) of the branched passages 616*a*, 616*b* are configured to communicate with respective cylinder member-side passages 333 via the communication holes 24*b* formed in the gasket 24.

Here, as described above, (an upper surface of) the gasket 24 constitutes a part of branched passages 35*b*, 35*c* of the air passage 35. That is, in this embodiment, the air passage 35 is isolated from the first scavenging passage 61 by the gasket 24, and the gasket 24 has an upper surface constituting a part of the air passage 35, and a lower surface constituting a part of the first scavenging passage 61.

Further, in this embodiment, as illustrated in FIGS. 8 and 9, the crankcase-side passage 612 of the first scavenging passage 61 is provided with a check valve (corresponding to "second check valve" of the present invention) 62 for preventing a negative pressure formed inside of the crankcase 53, from being propagated through the first scavenging intake 611 to the first scavenging passage 61. This check valve 62 may be a reed valve in the same manner as the check valve 37 provided in the air passage 35. The check valve (reed valve) 62 is attached to the outer surface of the crankcase 53 so as to cover the first scavenging intake 611, and the check valve 62 allows a flow from the inside of the crankcase 53 toward (the crankcase-side passage 612 of) the first scavenging passage 61, and inhibits a flow in the opposite direction.

Figure 11:
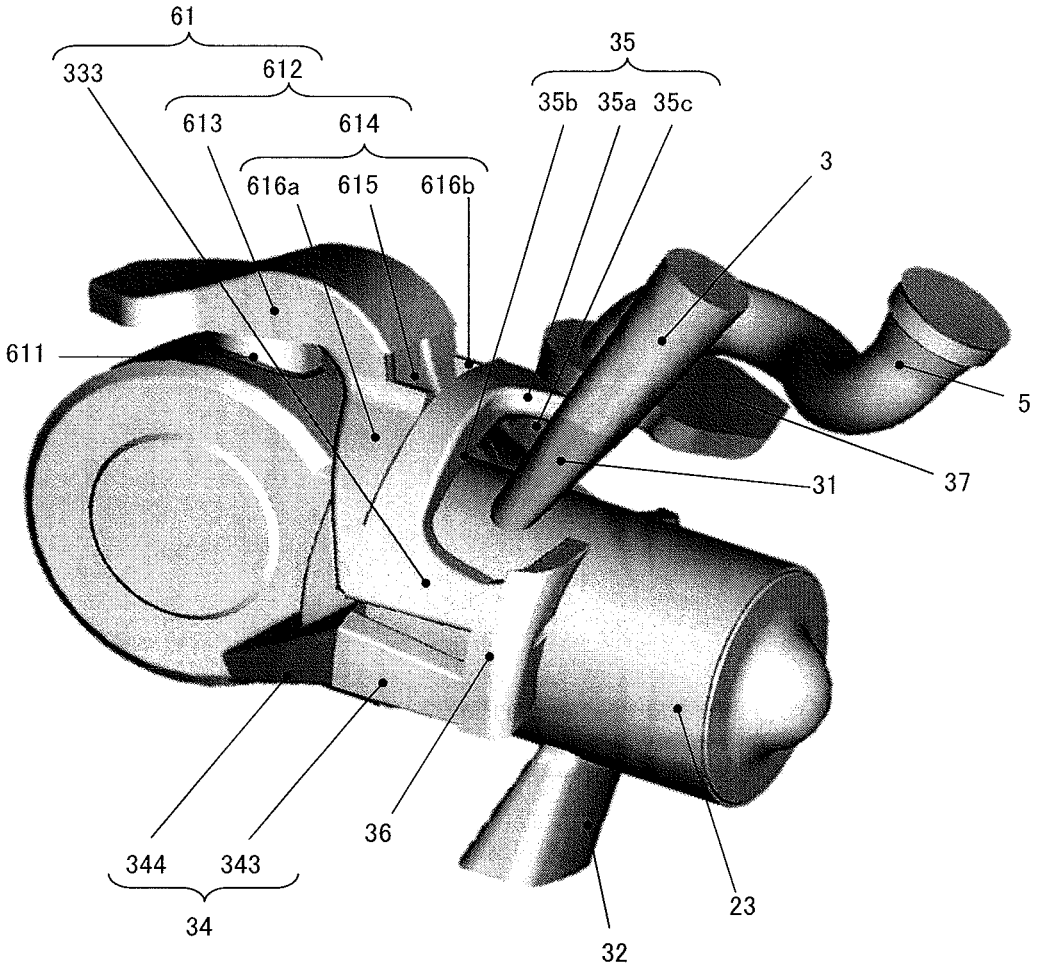
FIG. 11 is a schematic view illustrating passages of the stratified scavenging two-stroke engine according to the second embodiment.

FIG. 11 is a view schematically illustrating passages of the engine 50.

In the engine 50 of this embodiment, the first scavenging passage 61 has the crankcase-side passage 612 that includes the case-outside portion 613 extending upwardly from the first scavenging intake 611, and the subsequent case-inside passage portion 614 including the inner passage 615 branched into the branched passages 616*a* and 616*b* extending in different directions from each other along an outer circumference of the cylinder 23 on the cylinder base surface. The branched passages 616*a* and 616*b* have end portions connected to the pair of cylinder member-side passages 333, respectively, provided across the cylinder 23. Although not illustrated in FIG. 11, the crankcase-side passage 612 of the first scavenging passage 61 is provided with the check valve (reed valve) 62 that allows a flow from the inside of the crankcase 53 toward the first scavenging passage 61, and inhibits a flow in the opposite direction. Other passages are basically similar to those of the first embodiment.

Next, operation of the engine 50 of this embodiment will be described mainly in the points different from those of the operation of the engine 1 of the first embodiment.

When a piston 25 present at the bottom dead center starts to move toward the top dead center, a negative pressure is formed inside of the crankcase 53, and the negative pressure is developed along with ascend of the piston 25. The negative pressure formed inside of the crankcase 53 is propagated from the second scavenging intake 341 opening to the inside of the crankcase 53, through the second scavenging passage 34 toward the second scavenging port 342, and propagated through the communicating portion 36 to the first scavenging passage 61. At this time, the first scavenging intake 611 is closed by the check valve (reed valve) 62 so as to prevent the negative pressure inside of the crankcase 53 from being propagated via the first scavenging intake 611 into the first scavenging passage 61 in this embodiment.

In the middle stage of the upward stroke of the piston 25, when the pressure in the first scavenging passage 61 becomes lower than atmospheric pressure by the negative pressure formed inside of the crankcase 53, the check valve (reed valve) 37 provided in the air passage 35 opens. Consequently, air is introduced from the air passage 35 into the cylinder member-side passage 333 of the first scavenging passage 61, and air is also introduced through the communicating portion 36 into the second scavenging passage 34 (cylinder member-side passage 343). This introduction of air continues to the final stage of the upward stroke of the piston 25, which causes to fill with the air the most part of the cylinder member-side passage 333 of the first scavenging passage 61 and the most part of the second scavenging passage 34. When the piston 25 passes the intake port 311, the intake port 311 opens to the inside of the cylinder 23 below the piston 25, and the negative pressure inside of the crankcase 53 is propagated via the intake port 311 into the intake passage 31. Consequently, the gaseous mixture is introduced through the intake passage 31 to the inside of the crankcase 53.

Then, when the piston 25 further ascends to reach the top dead center or its vicinity, an ignition plug 29 operates to ignite a gaseous mixture (gaseous mixture is burned) in a combustion chamber 28, and the operation transits to the downward stroke of the piston 25.

In the middle stage of the downward stroke of the piston 25, when the piston 25 passes the exhaust port 321, the exhaust port 321 opens to the inside of the cylinder 23 above the piston 25, which causes to discharge the combustion gas inside of the cylinder 23 through the exhaust passage 32 to rapidly drop the pressure inside of the cylinder 23. Meanwhile, descend of the piston 25 causes to compress the gaseous mixture to raise the pressure in the crankcase 53. When the pressure in the crankcase 53 becomes higher than the pressure in the first scavenging passage 61, the check valve (reed valve) 62 opens to introduce the gaseous mixture in the crankcase 53 through the first scavenging intake 611 into the first scavenging passage 61. Further, the gaseous mixture in the crankcase 53 is also introduced through the second scavenging intake 32 into the second scavenging passage 34. At this time, the first scavenging port 332 and the second scavenging port 342 are closed by the piston 25, and the gaseous mixture introduced into the first scavenging passage 61 and the second scavenging passage 34 compresses air that has been introduced into the cylinder member-side passage 333 of the first scavenging passage 61 and the second scavenging passage 34 in the preceding upward stroke. Further, the check valve (reed valve) 37 provided in the air passage 35 prevents air or gaseous mixture in the first scavenging passage 61 from flowing into the air passage 35. Operation of the engine 50 after this stage is basically similar to that of the engine 1 according to the first embodiment.

According to the engine 50 of this embodiment, effects similar to those of the engine 1 of the first embodiment can be obtained. That is, it is possible to reduce the size of the engine 50 particularly in the vertical direction, and to thereby downsize the entire engine 50. Further, since the engine 50 of this embodiment has a scavenging passage (first scavenging passage 61) having a larger volume as compared with the engine 1 of the first embodiment, it has a merit that larger amount of air for pre-scavenging can be obtained. Here, the check valve 62 is provided in the crankcase side passage 612 of the first scavenging passage 61 in this embodiment, but the check valve 62 may be omitted.

Modified Example of Second Embodiment

Figure 12:
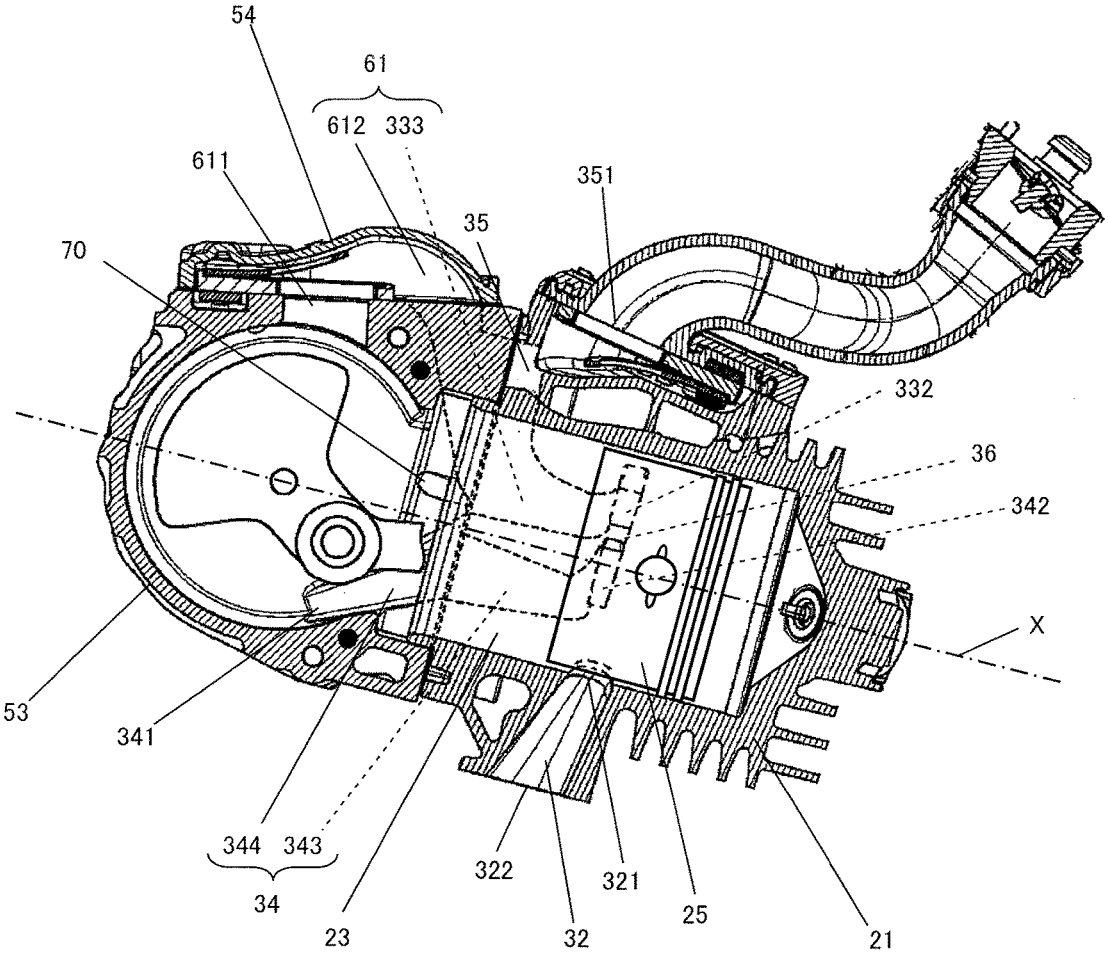
FIG. 12 is a cross-sectional view of a modified example of the stratified scavenging two-stroke engine according to the second embodiment.
Figure 13A:
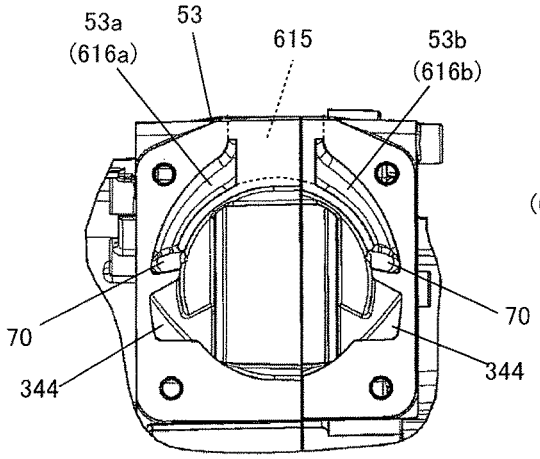
FIGS. 13A and 13B are views of a crankcase according to the modified example of the second embodiment observed from a position facing to a joining surface with a cylinder member (crankcase base surface).
Figure 13B:
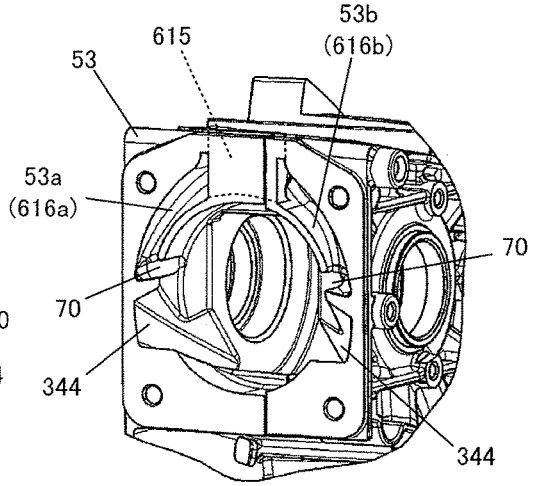
Figure 14:
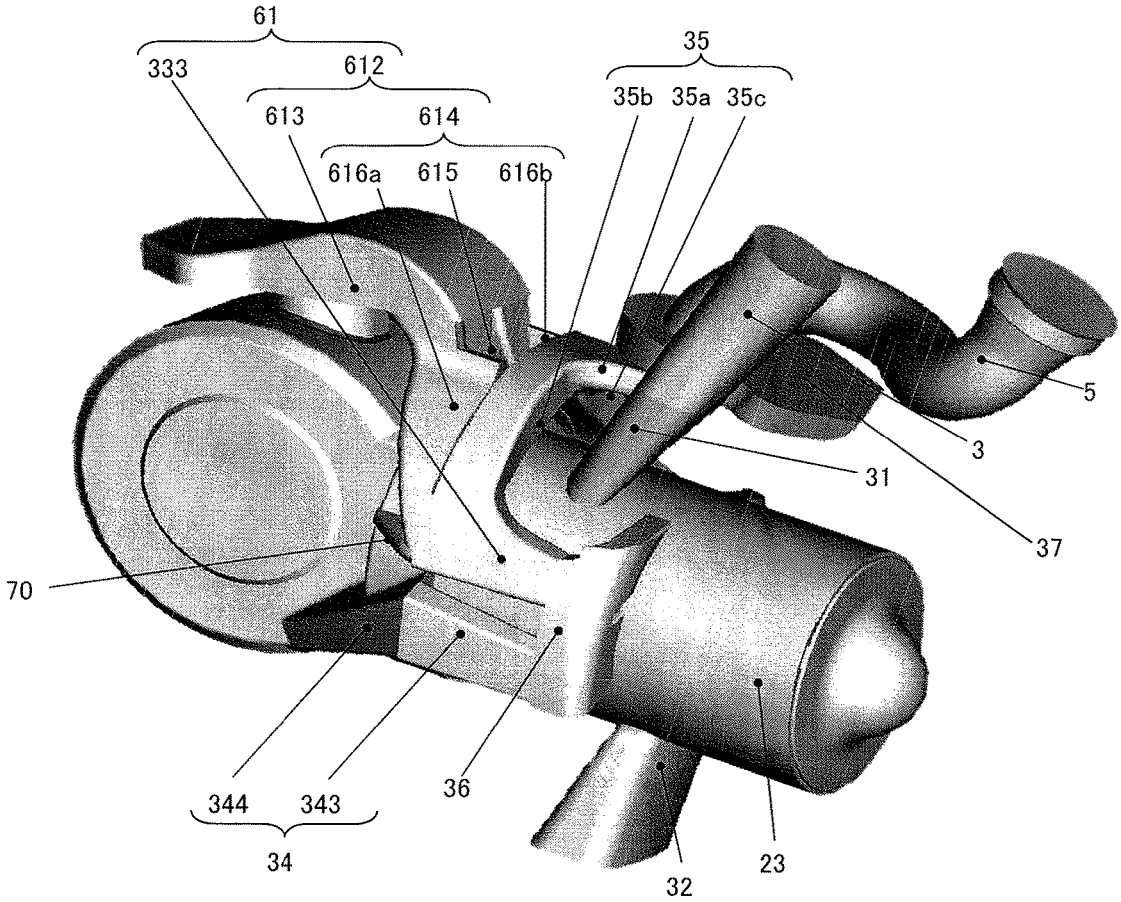
FIG. 14 is a schematic view illustrating passages of the stratified scavenging two-stroke engine according to the modified example of the second embodiment.

FIGS. 12 to 14 illustrate a modified example of the engine 50 of the second embodiment. FIG. 12 is a view corresponding to FIG. 8, FIGS. 13A and 13B are views corresponding to FIGS. 10A and 10B, and FIG. 14 is a view corresponding to FIG. 11.

In this modified example, beside the crankcase-side passage 612, a connecting passage 70 connected to the cylinder member-side passage 333 of the first scavenging passage 61 is provided. The connecting passage 70 extends substantially in parallel to the axis X of the cylinder 23 from the upper portion in the crankcase 53, through the communication hole 24*c* of the gasket 24 and connected to the cylinder member-side passage portion 333 of the first scavenging passage 61. The connecting passage 70 has a cross-sectional area smaller than those of the crankcase-side passage 612 of the first scavenging passage 61 and the crankcase-side passage 344 of the second scavenging passage 34, and two connecting passages 70 are provided on respective sides across the axis X of the cylinder 23.

According to this modified example, particularly in the downward stroke of the piston 25, in the first scavenging passage 61, the gaseous mixture in the crankcase 53 flows in parallel through the first scavenging intake 611 and the connecting passage 70 to the inside of the cylinder 23. Accordingly, the amount of gaseous mixture that has flowed out to the inside of the cylinder 23 after pre-scavenging by air becomes greater than that of the second embodiment. Consequently, it is possible to perform scavenging of combustion gas remaining inside of the cylinder 23 and air that has been introduced into the cylinder 23 earlier, and to improve output of the engine 1.

In the above, the embodiments of the present invention and their modified example have been described, but the present invention is not limited to the above embodiments or modified example, and further modifications or changes based on the technical concept of the present invention are possible. Some of them will be described.

For example, in the above embodiments and modified example, the crankcase 22, 53 is joined with the cylinder member 21, but the construction is not limited thereto. The construction may be such that the cylinder member 21 integrally has a part (upper part) of the crankcase 22, 53 and that a crankcase-forming member forming a part (lower part) of the crankcase 22, 53 is joined with the cylinder member 21. In this case, basically, each of the above crankcase-side passages 334, 344, 612 is formed in the crankcase-forming member.

Further, in the above embodiments and modified example, the intake 312 and the air inlet 351 open through the same flat portion 21*a* of an outer surface of the cylinder member 21, and the intake 312 and the air inlet 351 are arranged side by side in a direction substantially perpendicular to the axis X of the cylinder 23. However, the construction is not limited thereto, and the intake 312 and the air inlet 351 may open through different flat portions of the outer surface of the cylinder member 21. For example, two flat portions are provided adjacently to each other in substantially circumferential direction of the cylinder 23 or a direction substantially perpendicular to the axis X of the cylinder 23 on the outer surface of the cylinder member 21, and the intake 312 opens through one of the flat portions and the air inlet 351 opens through the other of the flat portions. In this case, the two flat portions may be independently formed on the outer surface of the cylinder member 21, or they may be continuous to each other via a slope etc. Further, the check valve (reed valve) 37 may be attached to the flat portion through which the air inlet 351 opens.

Such a construction satisfies the feature that the intake 312 and the air inlet 351 are arranged side by side in a substantially circumferential direction of the cylinder 23 or a direction substantially perpendicular to the axis X of the cylinder 23.

Further, in the above embodiments and modified example, the gasket 24 is employed as an interposed member interposed (disposed) at a joining portion between the cylinder member 21 and the crankcase 22, 53. However, the construction is not limited thereto. The interposed member may be any member which can communicate the cylinder member-side passages 333, 343 with the crankcase-side passages 334, 344, 612 of the scavenging passages (first scavenging passage 33, 61, second scavenging passage 34), and e.g. a liquid gasket may be employed as the interposed member.

Further, in the above embodiments and modified example, reed valves are employed as the check valve 37 provided in the air passage 35 and the check valve 62 provided in the first scavenging passage 61 (crankcase-side passage 612). However, the check valves are not limited thereto and various types of valve mechanisms having similar functions may be employed. The check valve 37 may be provided on the air duct 5 side.

Further, in the above embodiments and modified example, the cylinder member-side passage 333 of the first scavenging passage 33, 61 and the cylinder member-side passage 343 of the second scavenging passage 34 communicate with each other via the communicating portion 36 formed in the cylinder member 21. But the present invention is not limited thereto, and instead of or in addition to the communicating portion 36, for example, the cylinder member-side passage 333 of the first scavenging passage 33, 61 and the cylinder member-side passage 343 of the second scavenging passage 34 may be configured to communicate with each other via a concave portion or a groove formed into a peripheral wall of the piston 25. In this case, the concave portion or the groove formed into the peripheral wall of the piston 25 corresponds to the "communicating portion".

Further, in the above embodiments and modified example, the engines 1, 50 are provided with the first scavenging passage 33, 61 and the second scavenging passage 34. However, in addition to them, an additional scavenging passage (third scavenging passage) may be provided. Further, the cylinder member-side passages of the scavenging passages may be branched so that ends of the branched passages communicate with the inside of the cylinder 23 via the scavenging ports.

As described above, in the stratified scavenging two-stroke engine proposed in the present invention, the intake of the intake passage and the air inlet of the air passage open through the outer surface of the cylinder member at opposite positions from the position through which the exhaust outlet opens across the axis of the cylinder. Further, the intake and the air inlet are arranged side by side in a substantially circumferential direction of the cylinder or a direction substantially perpendicular to the axis of the cylinder. Accordingly, it is possible to reduce the size of the engine particularly in vertical direction (axis direction of the cylinder) as compared with conventional engines, and to thereby downsize the entire engine.

What is claimed is:

1. A stratified scavenging two-stroke engine including either a cylinder member in which a cylinder housing a piston is formed and a crankcase joined with the cylinder member, or the cylinder member and a crankcase-forming member forming a part of the crankcase joined with the cylinder member, the engine comprising:

an intake passage that connects an intake that opens through an outer surface of the cylinder member with an intake port that opens to the inside of the cylinder according to movement of the position of the piston, and is configured to supply a gaseous mixture of fuel and air to the inside of the crankcase;

an exhaust passage that connects an exhaust outlet that opens through the outer surface of the cylinder member with an exhaust port that opens to the inside of the cylinder according to movement of the position of the piston, and is configured to discharge a combustion gas inside of the cylinder;

a scavenging passage that connects a scavenging intake that opens to the inside of the crankcase with a scavenging port that opens to the inside of the cylinder according to movement of the position of the piston; and an air passage that connects an air inlet that opens through the outer surface of the cylinder member with the scavenging passage and is configured to supply air for pre-scavenging into the scavenging passage, wherein the intake and the air inlet are arranged at positions opposite from the exhaust outlet across an axis of the cylinder, and the intake and the air inlet are arranged side by side in a substantially circumferential direction of the cylinder in such a manner that the intake and the air inlet do not overlap in a direction along the axis of the cylinder.

2. The stratified scavenging two-stroke engine according to claim 1, wherein the intake and the air inlet open through a common flat portion of the outer surface of the cylinder member.

3. The stratified scavenging two-stroke engine according to claim 1, wherein the intake opens through one of two flat portions provided adjacently to each other in the substantially circumferential direction of the cylinder on the outer surface of the cylinder member, and the air inlet opens through the other of the two flat portions.

4. The stratified scavenging two-stroke engine according to claim 1, wherein the air passage is configured to supply the air for pre-scavenging into the scavenging passage through a check valve that opens during an upward stroke of the piston.

5. The stratified scavenging two-stroke engine according to claim 4, wherein the check valve is attached to a flat portion through which the air inlet opens, and the check valve opens by a negative pressure formed inside of the crankcase.

6. The stratified scavenging two-stroke engine according to claim 1, wherein the scavenging passage has a cylinder member-side passage and a crankcase-side passage, and wherein the cylinder member-side passage and the crankcase-side passage communicate with each other via an opening of an interposed member provided in a joining portion between either the cylinder member and the crankcase or between the cylinder member and the crankcase-forming member.

7. The stratified scavenging two-stroke engine according to claim 1, wherein the scavenging passage includes:

a first scavenging passage that connects a first scavenging intake opening to the inside of the crankcase and a first scavenging port opening to the inside of the cylinder according to movement of the position of the piston, and has a cylinder member-side passage and a crankcase side-passage;

a second scavenging passage that connects a second scavenging intake opening to the inside of the crankcase and a second scavenging port opening to the inside of the cylinder according to movement of the position of the piston, and has a cylinder member-side passage and a crankcase side-passage; and a communicating portion through which the cylinder member-side passage of the first scavenging passage communicates with the cylinder member-side passage of the second scavenging passage, and wherein the air passage connects the air inlet with the cylinder member-side passage of the first scavenging passage.

8. The stratified scavenging two-stroke engine according to claim 7, wherein the communicating portion is formed in one of a side wall of the cylinder member or a peripheral wall of the piston.

9. The stratified scavenging two-stroke engine according to claim 7, wherein the cylinder member-side passage of the first scavenging passage communicates with the crankcase-side passage of the first scavenging passage via a first opening of an interposed member provided in a joining portion between either the cylinder member and the crankcase or between the cylinder member and the crankcase-forming member, and the cylinder member-side passage of the second scavenging passage communicates with the crankcase-side passage of the second scavenging passage via a second opening of the interposed member.

10. The stratified scavenging two-stroke engine according to claim 9, wherein the interposed member has an upper surface constituting a part of the air passage.

11. The stratified scavenging two-stroke engine according to claim 10, wherein the interposed member has a guide portion that is formed so that air passing along the upper surface of the interposed member is guided toward the cylinder member-side passage of the first scavenging passage.

12. The stratified scavenging two-stroke engine according to claim 11, wherein the guide portion is formed so as to extend to a point above the first opening.

13. The stratified scavenging two-stroke engine according to claim 11, wherein the guide portion is formed so as to gradually ascend toward a tip of the guide portion.

14. The stratified scavenging two-stroke engine according to claim 9, wherein the interposed member has a lower surface constituting a part of the crankcase-side passage of the first scavenging passage.

15. The stratified scavenging two-stroke engine according to claim 7, wherein the crankcase-side passage of the first scavenging passage is provided with a second check valve that opens during a downward stroke of the piston.

16. The stratified scavenging two-stroke engine according to claim 15, wherein the second check valve opens when a pressure inside the crankcase is higher than a pressure in the first scavenging passage.

17. The stratified scavenging two-stroke engine according to claim 7, further comprising a connecting passage that is provided separately from the crankcase-side passage of the first scavenging passage and that extends from the inside of the crankcase in a direction substantially in parallel to the axis of the cylinder and is connected to the cylinder member-side passage of the first scavenging passage.

18. A stratified scavenging two-stroke engine including either a cylinder member in which a cylinder housing a piston is formed and a crankcase joined with the cylinder member, or the cylinder member and a crankcase-forming member forming a part of the crankcase joined with the cylinder member, the engine comprising:

an intake passage that connects an intake that opens through an outer surface of the cylinder member with an intake port that opens to the inside of the cylinder according to movement of the position of the piston, and is configured to supply a gaseous mixture of fuel and air to the inside of the crankcase;

an exhaust passage that connects an exhaust outlet that opens through the outer surface of the cylinder member with an exhaust port that opens to the inside of the cylinder according to movement of the position of the piston, and is configured to discharge a combustion gas inside of the cylinder;

a scavenging passage that connects a scavenging intake that opens to the inside of the crankcase with a scavenging port that opens to the inside of the cylinder according to movement of the position of the piston; and an air passage that connects an air inlet that opens through the outer surface of the cylinder member with the scavenging passage and is configured to supply air for pre-scavenging into the scavenging passage, wherein the intake and the air inlet are arranged at positions opposite from the exhaust outlet across an axis of the cylinder, and the intake and the air inlet are arranged side by side in a substantially circumferential direction of the cylinder in such a manner that the intake and the air inlet do not overlap in a direction along the axis of the cylinder, wherein the scavenging passage includes:

a first scavenging passage that connects a first scavenging intake opening to the inside of the crankcase and a first scavenging port opening to the inside of the cylinder according to movement of the position of the piston, and has a cylinder member-side passage and a crankcase side-passage;

a second scavenging passage that connects a second scavenging intake opening to the inside of the crankcase and a second scavenging port opening to the inside of the cylinder according to movement of the position of the piston, and has a cylinder member-side passage and a crankcase side-passage; and a communicating portion through which the cylinder member-side passage of the first scavenging passage communicates with the cylinder member-side passage of the second scavenging passage, wherein the air passage connects the air inlet with the cylinder member-side passage of the first scavenging passage, and wherein the air for pre-scavenging is introduced into the cylinder member-side passage of the first scavenging passage, and thereafter is introduced through the communicating portion into the cylinder member-side passage of the second scavenging passage.

19. The stratified scavenging two-stroke engine according to claim 18, wherein the intake and the air inlet are arranged side by side along a plane perpendicular to the axis of the cylinder in the substantially circumferential direction of the cylinder.

20. The stratified scavenging two-stroke engine according to claim 1, wherein the intake and the air inlet are arranged side by side along a plane perpendicular to the axis of the cylinder in the substantially circumferential direction of the cylinder.

* * * * *